US009744761B2

(12) United States Patent
Nozawa

(10) Patent No.: US 9,744,761 B2
(45) **Date of Patent: *Aug. 29, 2017**

(54) LIQUID DISCHARGE DEVICE AND HEAD UNIT

(71) Applicant: Seiko Epson Corporation, Tokyo (JP)

(72) Inventor: Dai Nozawa, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/145,155

(22) Filed: May 3, 2016

(65) Prior Publication Data

US 2017/0001435 A1 Jan. 5, 2017

(30) Foreign Application Priority Data

Jul. 1, 2015 (JP) ..... 2015-132438

(51) Int. Cl.
*B41J 2/045* (2006.01)

(52) U.S. Cl.
CPC ..... *B41J 2/04541* (2013.01); *B41J 2/0455* (2013.01); *B41J 2/04581* (2013.01); *B41J 2/04588* (2013.01); *B41J 2202/11* (2013.01)

(58) Field of Classification Search
None
See application file for complete search history.

(56) References Cited

U.S. PATENT DOCUMENTS

2012/0182339 A1 7/2012 Oshima et al.
2013/0241983 A1 9/2013 Aoki et al.
2014/0285579 A1* 9/2014 Oshima ..... B41J 2/04541 347/50
2014/0354352 A1 12/2014 Noro

FOREIGN PATENT DOCUMENTS

JP 2010-114711 A 5/2010
JP 2013-118628 A 6/2013

OTHER PUBLICATIONS

Extended European Search Report for Application No. EP 16 17 4061 dated Jan. 18, 2017 (6 pages).

* cited by examiner

*Primary Examiner* — Lisa M Solomon
(74) *Attorney, Agent, or Firm* — Harness, Dickey & Pierce, P.L.C.

(57) ABSTRACT

A liquid discharge device includes a modulation circuit that generates a modulation signal obtained by pulse-modulating a source signal by self oscillation, a transistor pair which includes a high side transistor and a low side transistor and which generates an amplified modulation signal by amplifying the modulation signal, a demodulator which includes an inductor and a capacitor and which generates a drive signal by smoothing the amplified modulation signal, an piezoelectric element that is displaced when the drive signal is applied, a cavity inside which a liquid droplet is filled and whose internal volume is changed by the displacement of the piezoelectric element, and a nozzle provided to discharge liquid inside the cavity according to the change of the internal volume of the cavity. A distance between the high side transistor and the capacitor is longer than a distance between the inductor and the capacitor.

6 Claims, 12 Drawing Sheets

<DECODE CONTENT OF DECODER>

| PRINT DATA Data | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

MSB LSB

<WIRING PATTERN>

<ARRANGEMENT OF ELEMENTS (RELATIONSHIP WITH WIRING PATTERN)>

FIG. 15 <L-C DISTANCE — RIPPLE VOLTAGE (WIDTH)>
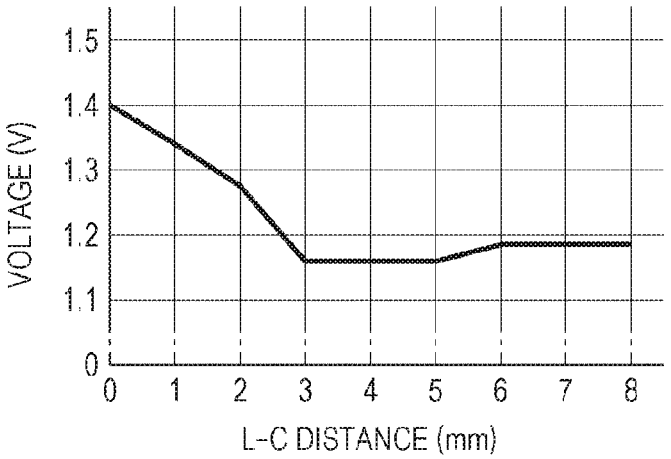
FIG. 16 <L-C DISTANCE — RIPPLE VOLTAGE (CENTER)>
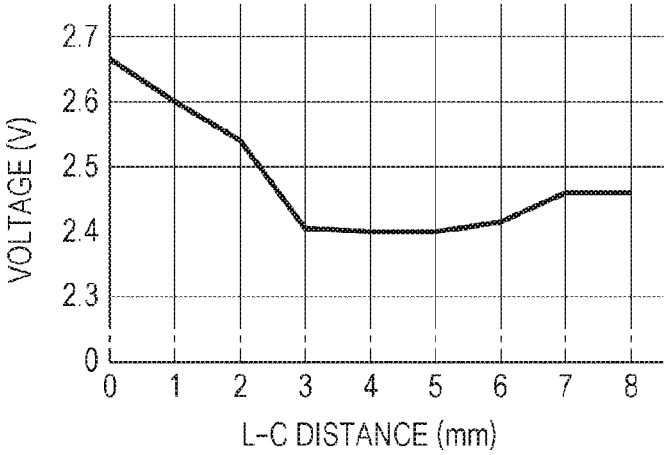
FIG. 17
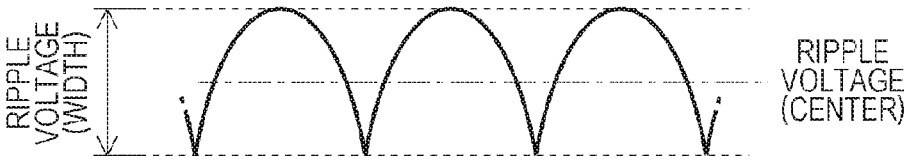

LIQUID DISCHARGE DEVICE AND HEAD UNIT

The entire disclosure of Japanese Patent Application No. 2015-132438, filed Jul. 1, 2015 is expressly incorporated by reference herein.

BACKGROUND

1. Technical Field

The present invention relates to a liquid discharge device and a head unit.

2. Related Art

As an ink jet printer that prints images and texts by discharging ink, a printer that uses piezoelectric elements is known. The piezoelectric element is provided corresponding to each of a plurality of nozzles in a head unit. Each piezoelectric element is driven according to a drive signal, so that a predetermined amount of ink (liquid) is discharged from a nozzle at a predetermined timing, and a dot is formed. The piezoelectric element is a capacitive load such as a capacitor from an electrical point of view, so that a sufficient amount of current has to be supplied to drive the piezoelectric element of each nozzle.

Therefore, a drive signal amplified by an amplifier circuit is supplied to the head unit to drive the piezoelectric element. As the amplifier circuit, there is a method where a source signal before amplification is amplified by a class AB amplifier. However, this method is not energy-efficient. Therefore, in recent years, a method using a class D amplifier is proposed (see JP-A-2010-114711). To put it plainly, the class D amplifier amplifies an input signal by performing pulse width modulation and/or pulse density modulation on a source signal, switching a high side transistor and a low side transistor serially inserted between power supply voltages according to the modulation signal, and demodulating an output signal generated from the switching by using a low pass filter (a demodulator) including an inductor (a coil) and a capacitor.

To cause a piezoelectric element to discharge ink by a drive signal amplified by the class D amplifier, it is necessary to raise the frequency of the modulation signal to some extent. However, a problem is pointed out where, when switching the high side transistor and the low side transistor according to a modulation signal of a relatively high frequency, an operation becomes unstable due to effects of noise and the like.

SUMMARY

An advantage of some aspects of the invention is to provide a technique to stabilize an operation in a liquid discharge device which class-D-amplifies a drive signal applied to a piezoelectric element.

To achieve the advantage, a liquid discharge device according to an aspect of the invention includes a modulation circuit that generates a modulation signal obtained by pulse-modulating a source signal by self oscillation, a transistor pair which includes a high side transistor and a low side transistor and which generates an amplified modulation signal by amplifying the modulation signal, a demodulator which includes an inductor and a capacitor and which generates a drive signal by smoothing the amplified modulation signal, an piezoelectric element that is displaced when the drive signal is applied, a cavity inside which a liquid droplet is filled and whose internal volume is changed by the displacement of the piezoelectric element, and a nozzle provided to discharge liquid inside the cavity according to the change of the internal volume of the cavity. A distance between the high side transistor and the capacitor is longer than a distance between the inductor and the capacitor.

According to the liquid discharge device according to the aspect, the high side transistor and the capacitor are separated from each other, so that effects which noise generated when a higher voltage is switched has on the capacitor are reduced. Further, the inductor and the capacitor are close to each other, so that an inductance component parasitizing in the capacitor is small. Therefore, it is possible to reduce generation of abnormal oscillation of the modulation signal (for example, oscillating at a frequency two times the assumed frequency), variation of frequency, and the like.

The distances here are, for example, a shortest length from an outer shape of one element to an outer shape of the other element in a state in which the elements are mounted on a circuit board. The source signal is a signal that is a source of the drive signal that defines a displacement of the piezoelectric element, that is, a signal before modulation and a signal to be a reference of a waveform of the drive signal (including a defining signal regardless of analog or digital). The modulation signal is a digital signal obtained by pulse-modulating (for example, pulse-width-modulating or pulse-density-modulating) the source signal.

By the way, in the liquid discharge device according to the aspect, when the distance between the inductor and the capacitor is short, leakage flux from the inductor may affect the capacitor. Therefore, it is desirable that the distance between the inductor and the capacitor is longer than or equal to 3 mm.

On the other hand, when the distance between the inductor and the capacitor is long, ripple of the drive signal, which is an output signal, becomes large due to an inductance component parasitizing in the capacitor, so that the drive signal may function in an unstable direction. Therefore, it is desirable that the distance between the inductor and the capacitor is shorter than or equal to 6 mm.

In the liquid discharge device according to the aspect, it is desirable that a distance between the low side transistor and the capacitor is shorter than the distance between the high side transistor and the capacitor. According to this configuration, an inductance component parasitizing in the capacitor is small, so that it is possible to reduce generation of abnormal oscillation of the modulation signal.

By the way, in the liquid discharge device according to the aspect, the drive signal is generated by smoothing the amplified modulation signal, the piezoelectric element is displaced when the drive signal is applied, and liquid is discharged from the nozzle. Here, when a frequency spectrum analysis is performed on the waveform of the drive signal for the liquid discharge device to discharge, for example, a small dot, it is known that a frequency component of 50 KHz or higher is included. To generate a drive signal including such a frequency component of 50 KHz or higher, it is necessary to set the frequency of the modulation signal to 1 MHz or higher.

Here, if the frequency of the modulation signal is set to lower than 1 MHz, an edge of a waveform of a reproduced drive signal is dulled and rounded. In other words, the waveform is rounded off and dulled. When the waveform of the drive signal is dulled, the displacement of the piezoelectric element that operates according to a rising edge and a falling edge of the waveform becomes dull, and a tailing during discharge and a discharge failure occur, so that the quality of printing is degraded.

On the other hand, when the frequency of the modulation signal is set to higher than 8 MHz, the resolution of the waveform of the drive signal is improved. However, switching loss increases due to increase of the switching frequency in a transistor, so that power saving properties and heat generation saving properties, which are better than those of linear amplification of a class AB amplifier or the like, are impaired.

Therefore, in the liquid discharge device according to the aspect, it is desirable that the frequency of the modulation signal is greater than or equal to 1 MHz and smaller than or equal to 8 MHz.

The invention can be implemented in various aspects, for example, the invention can be implemented as a single body of a head unit.

BRIEF DESCRIPTION OF THE DRAWINGS

The invention will be described with reference to the accompanying drawings, wherein like numbers reference like elements.

FIG. 15 is a diagram showing a relationship between an L-C distance and a ripple voltage (width).

FIG. 16 is a diagram showing a relationship between an L-C distance and a ripple voltage (center).

FIG. 17 is a diagram for explaining the ripple voltage.

DESCRIPTION OF EXEMPLARY EMBODIMENT

Hereinafter, an embodiment for implementing the invention will be described with reference to the drawings.

A printing device according to the embodiment is an ink jet printer, that is, a liquid discharge device, which forms ink dot groups on a medium such as a paper by discharging ink according to image data supplied from an external host computer and thereby prints an image (including characters, graphics, and the like) according to the image data.

Figure 1:
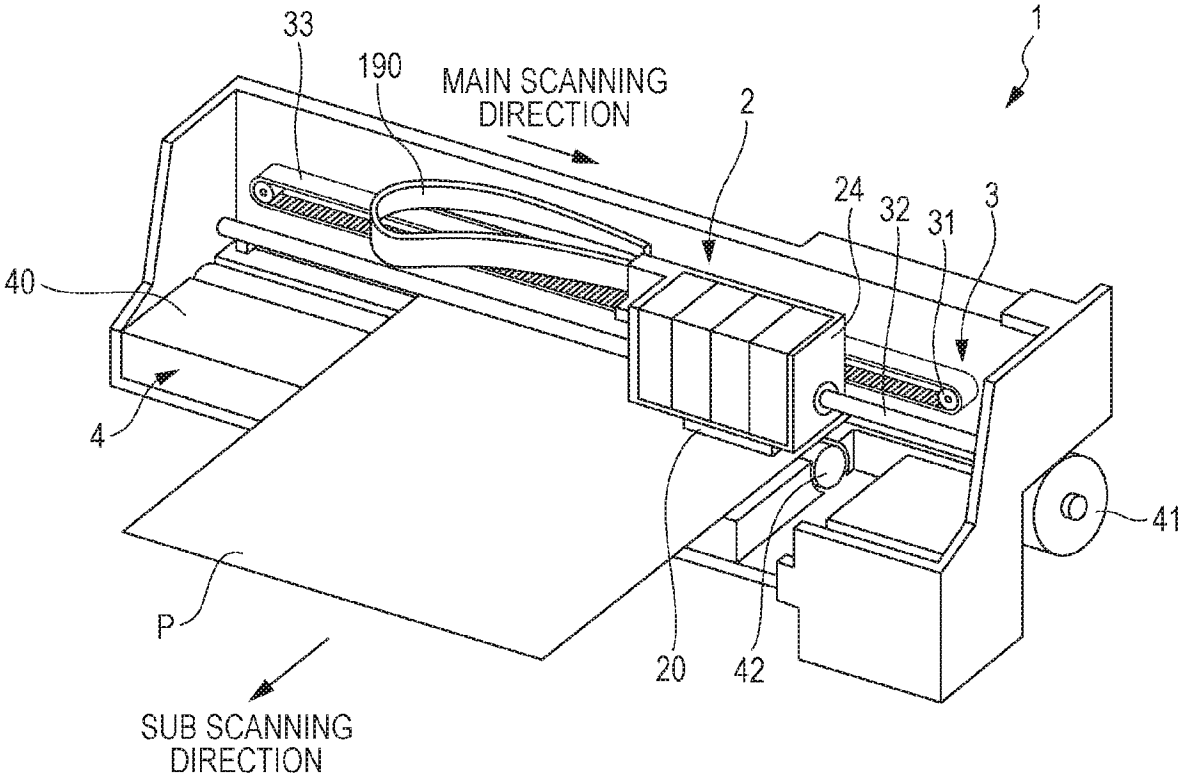
FIG. 1 is a diagram showing a schematic configuration of a printing device.

FIG. 1 is a perspective view showing a schematic configuration inside the printing device.

As shown in FIG. 1, the printing device 1 includes a moving mechanism 3 that moves (reciprocates) a moving body 2 in a main scanning direction.

The moving mechanism 3 includes a carriage motor 31 that is a drive source of the moving body 2, a carriage guide shaft 32 whose both ends are fixed, and a timing belt 33 which extends in almost parallel with the carriage guide shaft 32 and which is driven by the carriage motor 31.

A carriage 24 of the moving body 2 is reciprocatively supported by the carriage guide shaft 32 and is fixed to a part of the timing belt 33. Therefore, when the timing belt 33 is moved in forward and reverse directions by the carriage motor 31, the moving body 2 reciprocates by being guided by the carriage guide shaft 32.

A head unit 20 is provided to a portion which is a part of the moving body 2 and which faces a medium P. The head unit 20 is to discharge ink droplets (liquid droplets) from a large number of nozzles as described later and has a structure to which various control signals and the like are supplied through a flexible cable 190.

The printing device 1 includes a transport mechanism 4 that transports the medium P on a platen 40 in a sub scanning direction. The transport mechanism 4 includes a transport motor 41 that is a drive source and a transport roller 42 which is rotated by the transport motor 41 and transports the medium P in the sub scanning direction.

At a timing when the medium P is transported by the transport mechanism 4, the head unit 20 discharges ink droplets to the medium P, so that an image is formed on a surface of the medium P.

Figure 2:
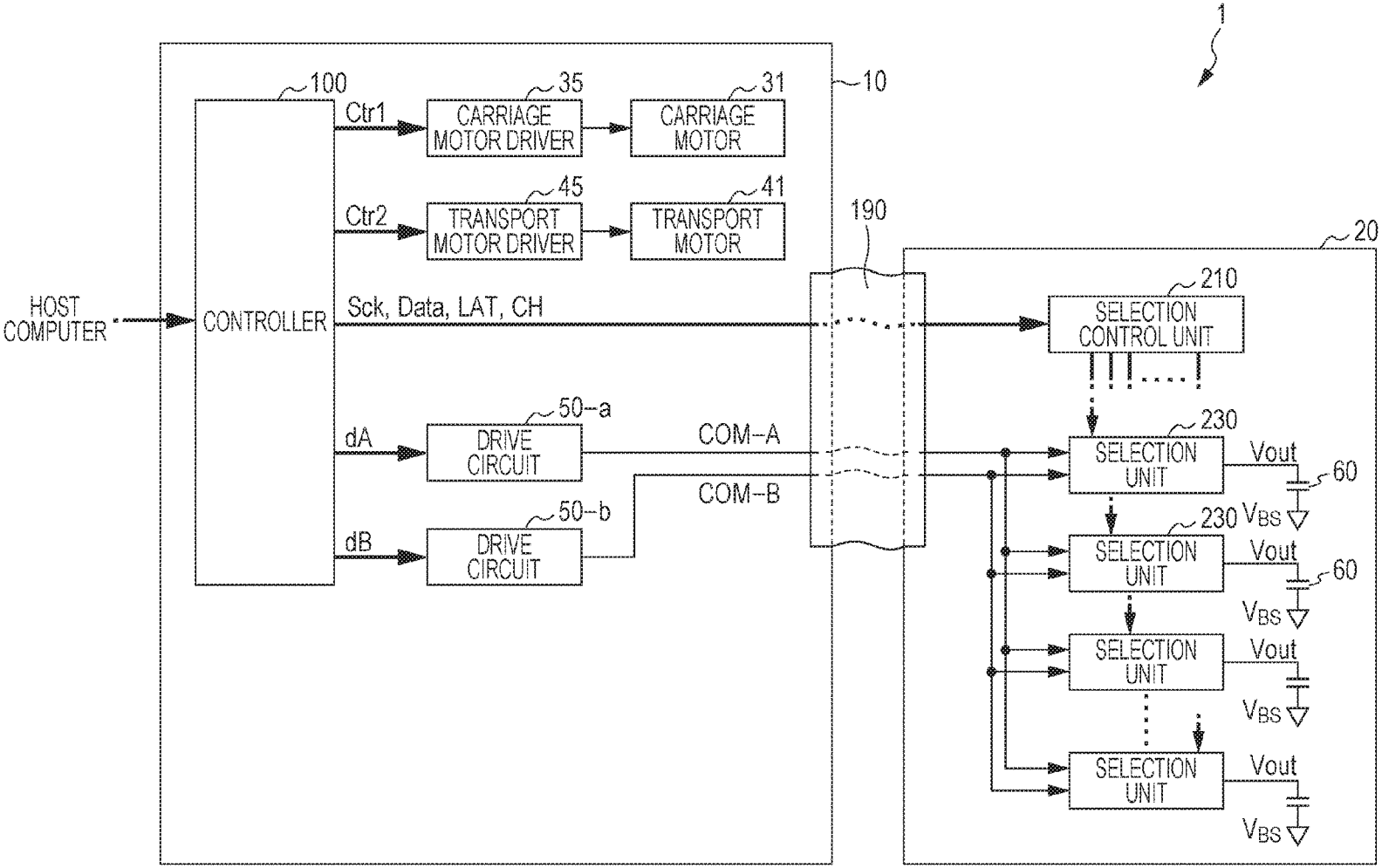
FIG. 2 is a block diagram showing a configuration of the printing device.

FIG. 2 is a block diagram showing an electrical configuration of the printing device.

As shown in FIG. 2, in the printing device 1, a control unit 10 and the head unit 20 are connected through the flexible cable 190.

The control unit 10 includes a controller 100, the carriage motor 31, a carriage motor driver 35, a transport motor 41, a transport motor driver 45, and two drive circuits 50-*a* and 50-*b*. Among them, the controller 100 outputs various control signals and the like for controlling each component when image data is supplied from the host computer.

Specifically, first, the controller 100 supplies a control signal Ctrl to the carriage motor driver 35 and the carriage motor driver 35 drives the carriage motor 31 according to the control signal Ctr1. Thereby, the movement of the carriage 24 in the main scanning direction is controlled.

Second, the controller 100 supplies a control signal Ctrl2 to the transport motor driver 45 and the transport motor driver 45 drives the transport motor 41 according to the control signal Ctr2. Thereby, the movement in the sub scanning direction by the transport mechanism 4 is controlled.

Third, the controller 100 supplies digital data dA to one drive circuit 50-*a* of the two drive circuits 50-*a* and 50-*b* and supplies digital data dB to the other drive circuit 50-*b*. Here, the data dA defines a waveform of a drive signal COM-A of drive signals supplied to the head unit 20 and the data dB defines a waveform of a drive signal COM-B of the drive signals.

Although the details will be described later, the drive circuit 50-*a* converts the data dA into analog data and then supplies a class-D-amplified drive signal COM-A to the head unit 20. In the same manner, the drive circuit 50-*b* converts the data dB into analog data and then supplies a class-D-amplified drive signal COM-B to the head unit 20.

Regarding the drive circuits 50-*a* and 50-*b*, only the data inputted into the drive circuits and the drive signals outputted from the drive circuits are different from each other and circuit configurations of the drive circuits are the same as described later. Therefore, when it is not necessary to distinguish the drive circuits 50-*a* and 50-*b* from each other (for example, when explaining FIG. 10 described later), "-(hyphen)" and the following letter are omitted and the signs are simply represented as "50".

Fourth, the controller 100 supplies a clock signal Sck, a data signal Data, control signals LAT and CH to the head unit 20.

The head unit 20 is provided with a selection control unit 210 and a plurality of pairs of a selection unit 230 and a piezoelectric element 60.

The selection control unit 210 instructs each of the selection unit 230 that any one of the drive signals COM-A and COM-B should be selected (or none of them should be selected) by the control signal or the like supplied from the controller 100. The selection unit 230 selects the drive signal COM-A or COM-B according to the instruction from the selection control unit 210 and supplies the selected drive signal COM-A or COM-B to one end of the piezoelectric element 60 as a drive signal. In FIG. 2, a voltage of the drive signal is represented as Vout.

In this example, a voltage $V_{BS}$ is commonly applied to the other end of each of the piezoelectric element 60.

The piezoelectric element 60 is provided corresponding to each of a plurality of nozzles in the head unit 20. The piezoelectric element 60 is displaced according to a difference between the voltage Vout of the drive signal selected by the selection unit 230 and the voltage $V_{BS}$ and discharges ink. Subsequently, a structure for discharging ink by driving the piezoelectric element 60 will be briefly described.

Figure 3:
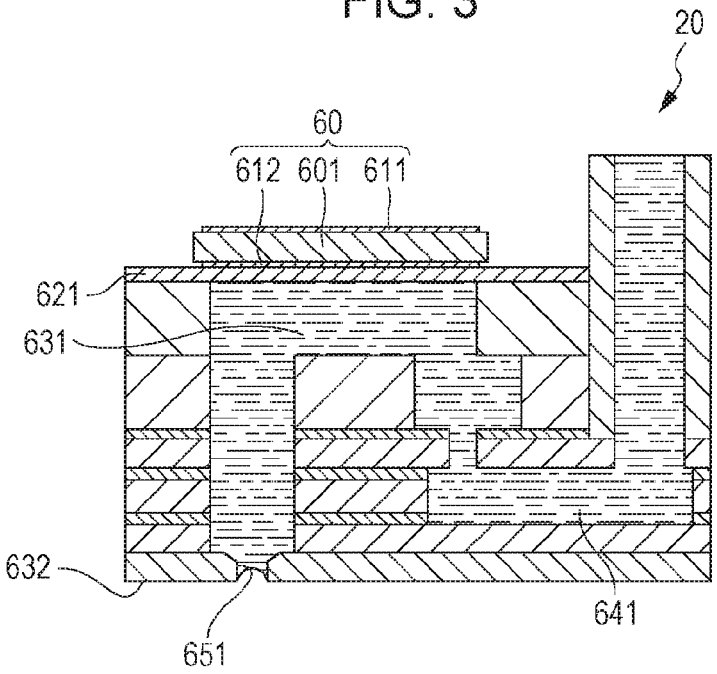
FIG. 3 is a diagram showing a configuration of a discharge unit in a head unit.

FIG. 3 is a diagram showing a schematic configuration corresponding to one nozzle in the head unit 20.

As shown in FIG. 3, the head unit 20 includes the piezoelectric element 60, a vibration plate 621, a cavity (a pressure chamber) 631, a reservoir 641, and a nozzle 651. Among them, the vibration plate 621 is displaced (bent and vibrated) by the piezoelectric element 60 provided on an upper surface in FIG. 3 and functions as a diaphragm that expands/contracts internal volume of the cavity 631 that is filled with ink. The nozzle 651 is an opening portion which is provided in a nozzle plate 632 and communicates with the cavity 631.

The piezoelectric element 60 shown in FIG. 3 has a structure in which a piezoelectric body 601 is sandwiched by a pair of electrodes 611 and 612. In the piezoelectric body 601 having this structure, the central portions of the electrodes 611 and 612 and the vibration plate 621 are bent in the vertical direction in FIG. 3 with respect to both end portions according to voltages applied by the electrodes 611 and 612. Specifically, when the voltage Vout of the drive signal becomes high, the piezoelectric element 60 is bent upward, and when the voltage Vout becomes low, the piezoelectric element 60 is bent downward. In this configuration, when the piezoelectric element 60 is bent upward, the internal volume of the cavity 631 expands, so that ink is drawn from the reservoir 641. On the other hand, when the piezoelectric element 60 is bent downward, the internal volume of the cavity 631 contracts, so that ink is discharged from the nozzle 651 depending on the size of the contraction.

The piezoelectric element 60 is not limited to the structure shown in the drawings, but may have a structure in which liquid such as ink can be discharged by deforming the piezoelectric element 60. The piezoelectric element 60 is not limited to having a structure using bending vibration, but may have a structure using so-called longitudinal vibration.

The piezoelectric element 60 is provided corresponding to the cavity 631 and the nozzle 651 in the head unit 20, and the piezoelectric element 60 is also provided corresponding to the selection unit 230 in FIG. 1. Therefore, a set of the piezoelectric element 60, the cavity 631, the nozzle 651, and the selection unit 230 is provided for each nozzle 651.

Figure 4A:
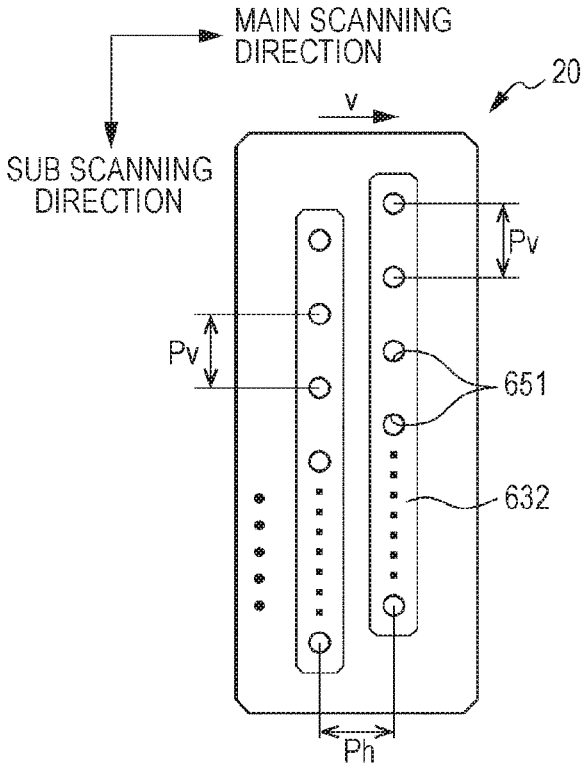
FIGS. 4A and 4B are diagrams showing a nozzle arrangement in the head unit.

FIG. 4A is a diagram showing an example of an arrangement of the nozzles 651.

As shown in FIG. 4A, the nozzles 651 are arranged in, for example, two columns as follows. In detail, in one column, a plurality of nozzles 651 are arranged at a pitch Pv along the sub scanning direction. On the other hand, the two columns are separated from each other by a pitch Ph in the main scanning direction and are shifted from each other by a half of the pitch Pv in the sub scanning direction.

Regarding the nozzles 651, when color printing is performed, patterns corresponding to colors such as C (cyan), M (magenta), Y (yellow), and K (black) are provided along the main scanning direction. However, in the description below, for simplification, a case in which gradation is represented by a single color will be described.

Figure 4B:
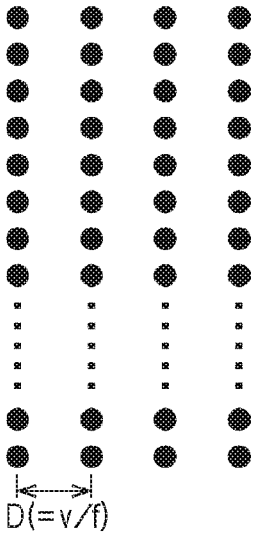

FIG. 4B is a diagram for explaining a basic resolution of image formation by the nozzle arrangement shown in FIG. 4A. For simplification of explanation, FIG. 4B is an example of a method (a first method) of forming one dot by causing the nozzle 651 to discharge an ink droplet once. A circle filled with black indicates a dot formed by a landed ink droplet.

When the head unit 20 moves at a speed v in the main scanning direction, as shown in FIG. 4B, a relationship between an interval D (in the main scanning direction) between dots formed by the landing of ink droplets and the speed v is as follows.

When one dot is formed by one-time discharge of ink droplet, the dot interval D is indicated by a value obtained by dividing the speed v by an ink discharge frequency f (=v/f), in other words, a distance in which the head unit 20 moves in a period (1/f) in which an ink drop let is discharged repeatedly.

In the example of FIGS. 4A and 4B, the pitch Ph is proportional to the dot interval D by a coefficient n, and ink droplets discharged from the nozzles 651 of the two columns are landed so that the ink droplets are aligned in the same column on the medium P. Therefore, as shown in FIG. 4B, the dot interval in the sub scanning direction is one half of the dot interval in the main scanning direction. It is needless to say that the dot arrangement is not limited to the example shown in FIG. 4B.

By the way, to realize high-speed printing, the speed v at which the head unit 20 moves in the main scanning direction should be simply increased. However, when the speed v is simply increased, the dot interval D is also increased. Therefore, to realize high-speed printing while securing a certain level of resolution, it is necessary to increase the number of dots formed per unit time by increasing the ink discharge frequency f.

To increase the resolution separately from the printing speed, the number of dots formed per unit area should be increased. However, when the number of dots is increased, not only adjacent dots are combined unless the amount of ink is reduced, but also the printing speed decreases unless the ink discharge frequency is increased.

As described above, to realize high speed printing and high resolution printing, it is necessary to increase the ink discharge frequency f.

On the other hand, as a method of forming a dot or dots on the medium P, in addition to a method of forming one dot by discharging an ink droplet once, there is a method (a second method) of forming one dot by enabling an ink droplet to be discharged two or more times during a unit period, causing one or more ink droplets discharged during the unit period to be landed, and combining the one or more landed ink droplets, and there is a method (a third method) of forming two or more dots without combining the two or more ink droplets. Hereinafter, a case will be described in which a dot is formed by the second method.

In the embodiment, the second method will be described by assuming an example as described below. In the embodiment, regarding one dot, four gradations including a large dot, a middle dot, a small dot, and no recording are represented by discharging ink at most two times. To represent the four gradations, in the embodiment, two types of drive signals COM-A and COM-B are prepared and each drive signal has a first half pattern and a second half pattern in one period. In the first half and the second half of one period, the drive signals COM-A and/or COM-B are selected (or not selected) according to a gradation to be represented and the selected drive signals COM-A and/or COM-B are supplied to the piezoelectric element 60.

Therefore, the drive signals COM-A and COM-B will be described and thereafter a configuration for selecting the drive signals COM-A and/or COM-B will be described. Each of the drive signals COM-A and COM-B is generated by the drive circuit 50. For convenience, the drive circuit 50 will be described after the description of the configuration for selecting the drive signals COM-A and/or COM-B.

Figure 5:
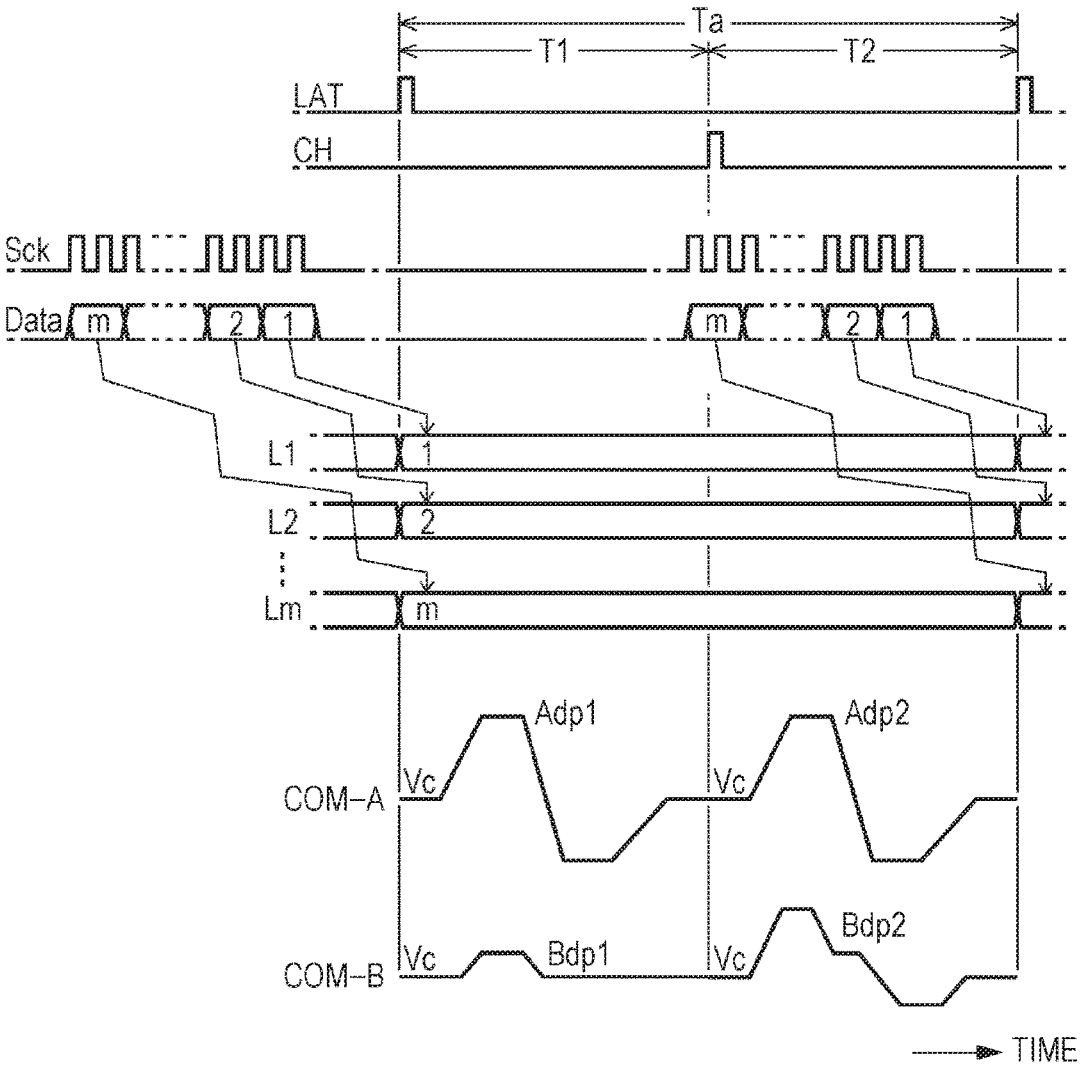
FIG. 5 is a diagram for explaining an operation of a selection control unit in the head unit.

FIG. 5 is a diagram showing waveforms of the drive signals COM-A and COM-B and the like.

As shown in FIG. 5, the drive signal COM-A has a waveform in which a trapezoidal waveform Adp1 arranged in a time period T1 from when the control signal LAT is outputted (rises) to when the control signal CH is outputted during a printing period Ta is connected with a trapezoidal waveform Adp2 arranged in a time period T2 from when the control signal CH is outputted to when the next control signal LAT is outputted during the printing period Ta.

In the embodiment, the trapezoidal waveforms Adp1 and Adp2 are substantially the same waveform. If each of the trapezoidal waveforms Adp1 and Adp2 is supplied to one end of the piezoelectric element 60, a predetermined amount of, specifically, an intermediate amount of ink is discharged from a nozzle 651 corresponding to the piezoelectric element 60.

The drive signal COM-B has a waveform in which a trapezoidal waveform Bdp1 arranged in the time period T1 is connected with a trapezoidal waveform Bdp2 arranged in the time period T2. In the embodiment, the trapezoidal waveforms Bdp1 and Bdp2 are waveforms different from each other. Among them, the trapezoidal waveform Bdp1 is a waveform for preventing viscosity of ink from increasing by slightly vibrating ink near the opening portion of the nozzle 651. Therefore, even if the trapezoidal waveform Bdp1 is supplied to one end of the piezoelectric element 60, no ink droplet is discharged from the nozzle 651 corresponding to the piezoelectric element 60. The trapezoidal waveform Bdp2 is a waveform different from the trapezoidal waveform Adp1 (Adp2). If the trapezoidal waveform Bdp2 is supplied to one end of the piezoelectric element 60, ink, the amount of which is smaller than the predetermined amount, is discharged from the nozzle 651 corresponding to the piezoelectric element 60.

The voltages at the beginning and the ending of the trapezoidal waveforms Adp1, Adp2, Bdp1, and Bdp2 are the same which is a voltage Vc. In other words, the trapezoidal waveforms Adp1, Adp2, Bdp1, and Bdp2 are waveforms which begin at the voltage Vc and end at the voltage Vc.

Figures 6, 7:
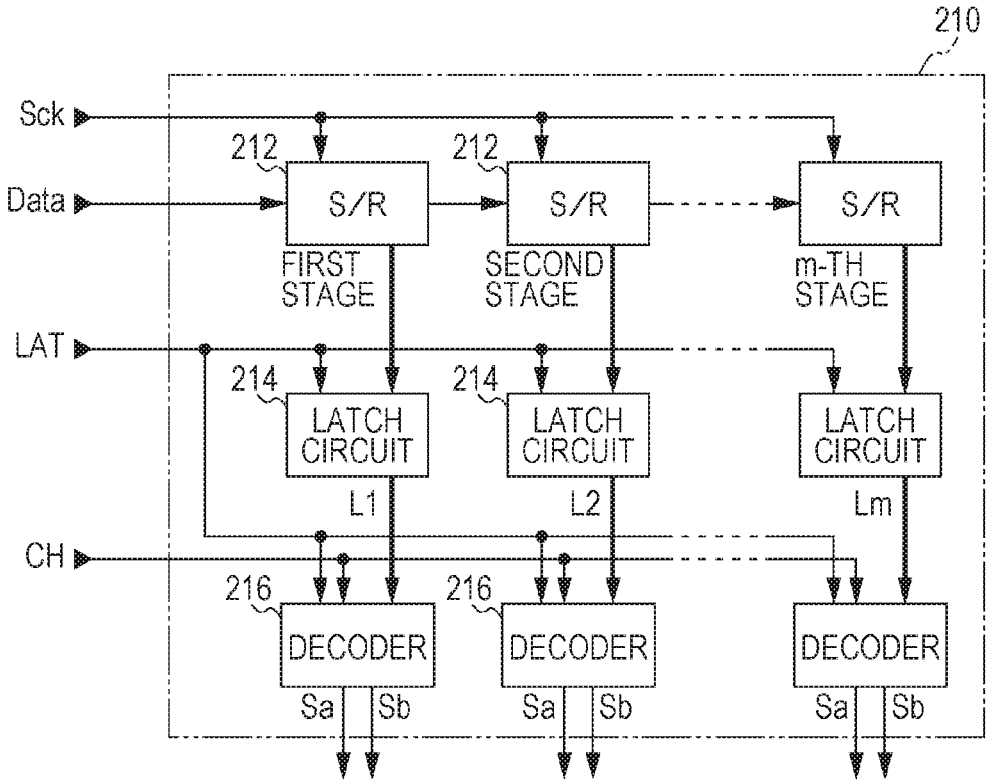
FIG. 6 is a diagram showing a configuration of the selection control unit in the head unit.
FIG. 7 is a diagram showing decode content of a decoder in the head unit.

FIG. 6 is a diagram showing a configuration of the selection control unit 210 in FIG. 2.

As shown in FIG. 6, the selection control unit 210 is provided with the clock signal Sck, the data signal Data, the control signals LAT and CH from the control unit 10. In the selection control unit 210, a set of a shift register (S/R) 212, a latch circuit 214, and a decoder 216 is provided corresponding to each of the piezoelectric elements 60 (the nozzles 651).

When one dot of an image is formed, the data signal Data defines a size of the dot. In the embodiment, the data signal Data comprises two bits including a most significant bit (MSB) and a least significant bit (LSB) in order to represent four gradations including no recording, a small dot, a middle dot, and a large dot.

The data signal Data is serially supplied from the controller 100 in accordance with the main scanning of the head unit 20 for each nozzle in synchronization with the clock signal Sck. The shift register 212 is a component for temporarily holding two bits of the serially supplied data signal Data corresponding to a nozzle.

Specifically, the shift registers 212, the number of which corresponds to the number of piezoelectric elements (nozzles), are cascade-connected and the serially supplied data signals Data are sequentially transferred to a subsequent stage according to the clock signal Sck.

When the number of piezoelectric elements 60 is m (m is a plural number), in order to distinguish the shift registers 212, the shift registers 212 are represented as first stage, second stage, . . . , and m-th stage in order from the upstream side from which the data signal Data is supplied.

The latch circuit 214 latches the data signal Data held by the shift register 212 at a rise of the control signal LAT.

The decoder 216 decodes the 2-bit data signal Data latched by the latch circuit 214, outputs selection signals Sa and Sb for each time periods T1 and T2 defined by the control signal LAT and the control signal CH, and defines selection in the selection unit 230.

FIG. 7 is a diagram showing decode content in the decoder 216.

In FIG. 7, the latched 2-bit print data Data is represented as (MSB, LSB). FIG. 7 means that, for example, when the latched print data Data is (0, 1), the decoder 216 sets logical levels of the selection signals Sa and Sb to H and L levels respectively in the time period T1, sets logical levels of the selection signals Sa and Sb to L and H levels respectively in the time period T2, and outputs the selection signals Sa and Sb.

The logical levels of the selection signals Sa and Sb are shifted to high-amplitude logic that is higher than logical levels of the clock signal Sck, the print data Data, the control signals LAT and CH by a level shifter (not shown in the drawings).

Figure 8:
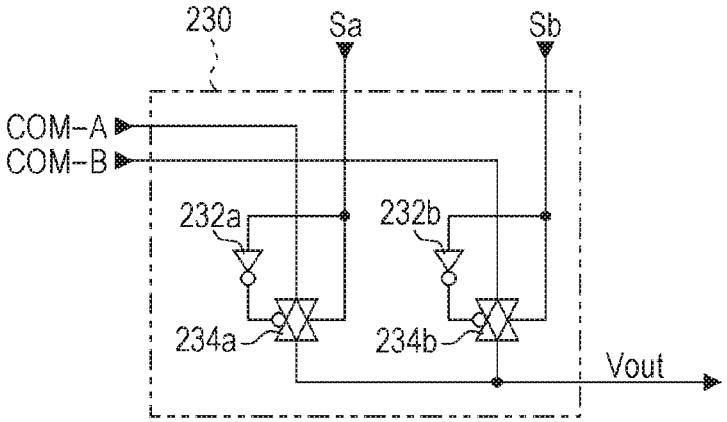
FIG. 8 is a diagram showing a configuration of the selection unit in the head unit.

FIG. 8 is a diagram showing a configuration of the selection unit 230 corresponding to one piezoelectric element 60 (nozzle 651) in FIG. 2.

As shown in FIG. 8, the selection unit 230 includes inverters (NOT circuits) 232*a* and 232*b* and transfer gates 234*a* and 234*b*.

The selection signal Sa from the decoder 216 is supplied to a positive control terminal, to which no circle mark is added, of the transfer gate 234*a*. On the other hand, the selection signal Sa is logically inverted by the inverter 232*a* and supplied to a negative control terminal, to which a circle mark is added, of the transfer gate 234*a*. Similarly, the selection signal Sb is supplied to a positive control terminal of the transfer gate 234*b*. On the other hand, the selection signal Sb is logically inverted by the inverter 232*b* and supplied to a negative control terminal of the transfer gate 234*b*.

The drive signal COM-A is supplied to the input terminal of the transfer gate 234*a* and the drive signal COM-B is supplied to the input terminal of the transfer gate 234*b*. The output terminals of the transfer gates 234*a* and 234*b* are connected together and connected to one end of the piezoelectric element 60.

When the selection signal Sa is H level, the transfer gate 234*a* electrically connects (turns on) between the input terminal and the output terminal, and when the selection signal Sa is L level, the transfer gate 234*a* electrically disconnects (turns off) between the input terminal and the output terminal. In the same manner, the transfer gate 234*b* turns on and off between the input terminal and the output terminal according to the selection signal Sb.

Next, an operation of the selection control unit 210 and the selection unit 230 will be described with reference to FIG. 5.

The data signals Data are serially supplied in synchronization with the clock signal Sck from the controller 100 for each nozzle and sequentially transferred by the shift register 212 corresponding to a nozzle. When the controller 100 stops the supply of the clock signal Sck, the data signal Data corresponding to a nozzle is held by each of the shift registers 212. The data signals Data are supplied in order of nozzles of the last m-th stage, . . . , the second stage, and the first stage of the shift registers 212.

Here, when the control signal LAT rises, each of the latch circuits 214 latches the data signal Data held by the shift register 212 at the same time. In FIG. 5, L1, L2, . . . , and Lm indicate the data signals Data latched by the latch circuits 214 corresponding to the shift registers 212 of the first stage, the second stage, . . . , and the m-th stage.

The decoder 216 outputs logical levels of the selection signals Sa and Sb by content as shown in FIG. 7 in each of the time periods T1 and T2 according to the size of dot defined by the latched data signal Data.

Specifically, first, when the data signal Data is (1, 1) and the decoder 216 defines the size of a large dot, the decoder 216 sets the selection signals Sa and Sb to H and L levels in the time period T1 and also sets the selection signals Sa and Sb to H and L levels in the time period T2. Second, when the data signal Data is (0, 1) and the decoder 216 defines the size of a middle dot, the decoder 216 sets the selection signals Sa and Sb to H and L levels in the time period T1 and sets the selection signals Sa and Sb to L and H levels in the time period T2. Third, when the data signal Data is (1, 0) and the decoder 216 defines the size of a small dot, the decoder 216 sets the selection signals Sa and Sb to L and L levels in the time period T1 and sets the selection signals Sa and Sb to L and H levels in the time period T2. Fourth, when the data signal Data is (0, 0) and the decoder 216 defines no recording, the decoder 216 sets the selection signals Sa and Sb to L and H levels in the time period T1 and sets the selection signals Sa and Sb to L and L levels in the time period T2.

Figure 9:
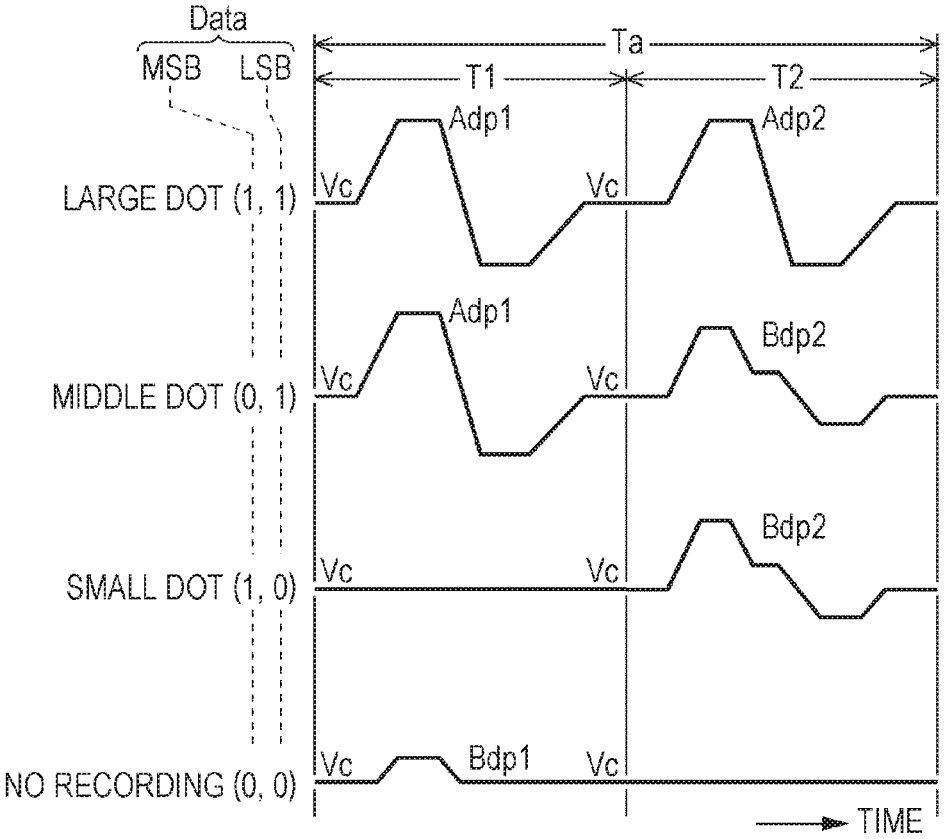
FIG. 9 is a diagram showing drive signals selected by the selection unit.

FIG. 9 is a diagram showing a voltage waveform of a drive signal which is selected according to the data signal Data and supplied to one end of the piezoelectric element 60.

When the data signal Data is (1, 1), the selection signals Sa and Sb are H and L levels in the time period T1, so that the transfer gate 234*a* is turned on and the transfer gate 234*b* is turned off. Therefore, the trapezoidal waveform Adp1 of the drive signal COM-A is selected in the time period T1. The selection signals Sa and Sb are H and L levels also in the time period T2, so that the selection unit 230 selects the trapezoidal waveform Adp2 of the drive signal COM-A.

In this way, when the trapezoidal waveform Adp1 is selected in the time period T1 and the trapezoidal waveform Adp2 is selected in the time period T2, and they are supplied to one end of the piezoelectric element 60 as a drive signal, an intermediate amount of ink is discharged twice from a nozzle 651 corresponding to the piezoelectric element 60. Therefore, two inks are landed on the medium P and incorporated. As a result, a large dot defined by the data signal Data is formed.

When the data signal Data is (0, 1), the selection signals Sa and Sb are H and L levels in the time period T1, so that the transfer gate 234*a* is turned on and the transfer gate 234*b* is turned off. Therefore, the trapezoidal waveform Adp1 of the drive signal COM-A is selected in the time period T1. Subsequently, the selection signals Sa and Sb are L and H levels in the time period T2, so that the trapezoidal waveform Bdp2 of the drive signal COM-B is selected.

Therefore, an intermediate amount of ink and a small amount of ink are separately discharged from a nozzle. Therefore, the two inks are landed on the medium P and incorporated. As a result, a middle dot defined by the data signal Data is formed.

When the data signal Data is (1, 0), both the selection signals Sa and Sb are L level in the time period T1, so that the transfer gates 234*a* and 234*b* are turned off. Therefore, neither of the trapezoidal waveforms Adp1 and Bdp1 is selected in the time period T1. When both the transfer gates 234*a* and 234*b* are turned off, a path from a connection point of the output terminals of the transfer gates 234*a* and 234*b* to one end of the piezoelectric element 60 becomes a high impedance state in which the path is not connected to anything. However, the piezoelectric element maintains a voltage ($Vc-V_{BS}$) immediately before the transfer gate is turned off due to capacitive characteristics of the piezoelectric element 60.

Subsequently, the selection signals Sa and Sb are L and H levels in the time period T2, so that the trapezoidal waveform Bdp2 of the drive signal COM-B is selected. Therefore, a small amount of ink is discharged from the nozzle 651 only in the time period T2, so that a small dot defined by the data signal Data is formed on the medium P.

When the data signal Data is (0, 0), the selection signals Sa and Sb are L and H levels in the time period T1, so that the transfer gate 234*a* is turned off and the transfer gate 234*b* is turned on. Therefore, the trapezoidal waveform Bdp1 of the drive signal COM-B is selected in the time period T1. Subsequently, both the selection signals Sa and Sb become L level in the time period T2, so that neither of the trapezoidal waveforms Adp2 and Bdp2 is selected.

Therefore, ink near the opening portion of the nozzle 651 only slightly vibrates in the time period T1 and the ink is not discharged. As a result, no dot is formed, that is to say, no recording is realized as defined by the data signal Data.

In this way, the selection unit 230 selects (or does not select) the drive signals COM-A and/or COM-B according to the instruction of the selection control unit 210 and supplies the drive signals COM-A and/or COM-B to one end of the piezoelectric element 60. Therefore, each piezoelectric element 60 is driven according to the size of dot defined by the data signal Data.

The drive signals COM-A and COM-B shown in FIG. 5 are only an example. In practice, a combination of various waveforms prepared in advance according to the moving speed of the head unit 20, the property of the medium P, and the like is used.

Here, an example is described in which the piezoelectric element 60 bends upward as the voltage rises. However, when the voltages supplied to the electrodes 611 and 612 are reversed, the piezoelectric element 60 bends downward as the voltage rises. Therefore, in a configuration in which the piezoelectric element 60 bends downward as the voltage rises, the drive signals COM-A and COM-B illustrated in the drawings have waveforms reversed with respect to the voltage Vc.

As described above, in the embodiment, one dot is formed on the medium P for every period Ta which is a unit period. Therefore, in the embodiment in which one dot is formed by discharging an ink droplet twice (at most) in the period Ta, the ink discharge frequency f is 2/Ta and the dot interval D is a value obtained by dividing the moving speed v of the head unit by the ink discharge frequency f (=2/Ta).

In general, when an ink droplet can be discharged Q times (Q is an integer greater than or equal to 2) during a unit period T and one dot is formed by discharging an ink droplet Q times, the ink discharge frequency f can be represented by Q/T.

When forming dots whose sizes are different from each other on the medium P as in the embodiment, it is necessary to shorten a time for discharging one ink droplet as compared with a case in which one dot is formed by discharging one ink droplet even when a time (a period) required to form one dot is the same.

It is not necessary to particularly describe a third method in which two or more dots are formed without combining two or more ink droplets.

Next, the drive circuits 50-*a* and 50-*b* will be described. Among them, one drive circuit 50-*a* will be roughly described. The drive circuit 50-*a* generates the drive signal COM-A as described below. The drive circuit 50-*a*, first, converts the data dA supplied from the controller 100 into analog data, second, feeds back an output drive signal COM-A, corrects a deviation between a signal (a damping signal) based on the drive signal COM-A and a target signal by a high frequency component of the drive signal COM-A, and generates a modulation signal according to the corrected signal, third, generates an amplified modulation signal by switching a transistor according to the modulation signal, and fourth, smoothes (demodulates) the amplified modulation signal by a low pass filter and outputs the smoothed signal as the drive signal COM-A.

The other drive circuit 50-*b* has a similar configuration and is different from the drive circuit 50-*a* only in a point that the drive signal COM-B is outputted from the data dB. Therefore, in FIG. 10 described below, the drive circuits 50-*a* and 50-*b* are not distinguished from each other and they will be described as a drive circuit 50.

However, inputted data and an outputted drive signal are represented as dA (dB) and COM-A (COM-B) and it is assumed that the data dA is inputted and the drive signal COM-A is outputted in the case of the drive circuit 50-*a* and the data dB is inputted and the drive signal COM-B is outputted in the case of the drive circuit 50-*b*.

Figure 10:
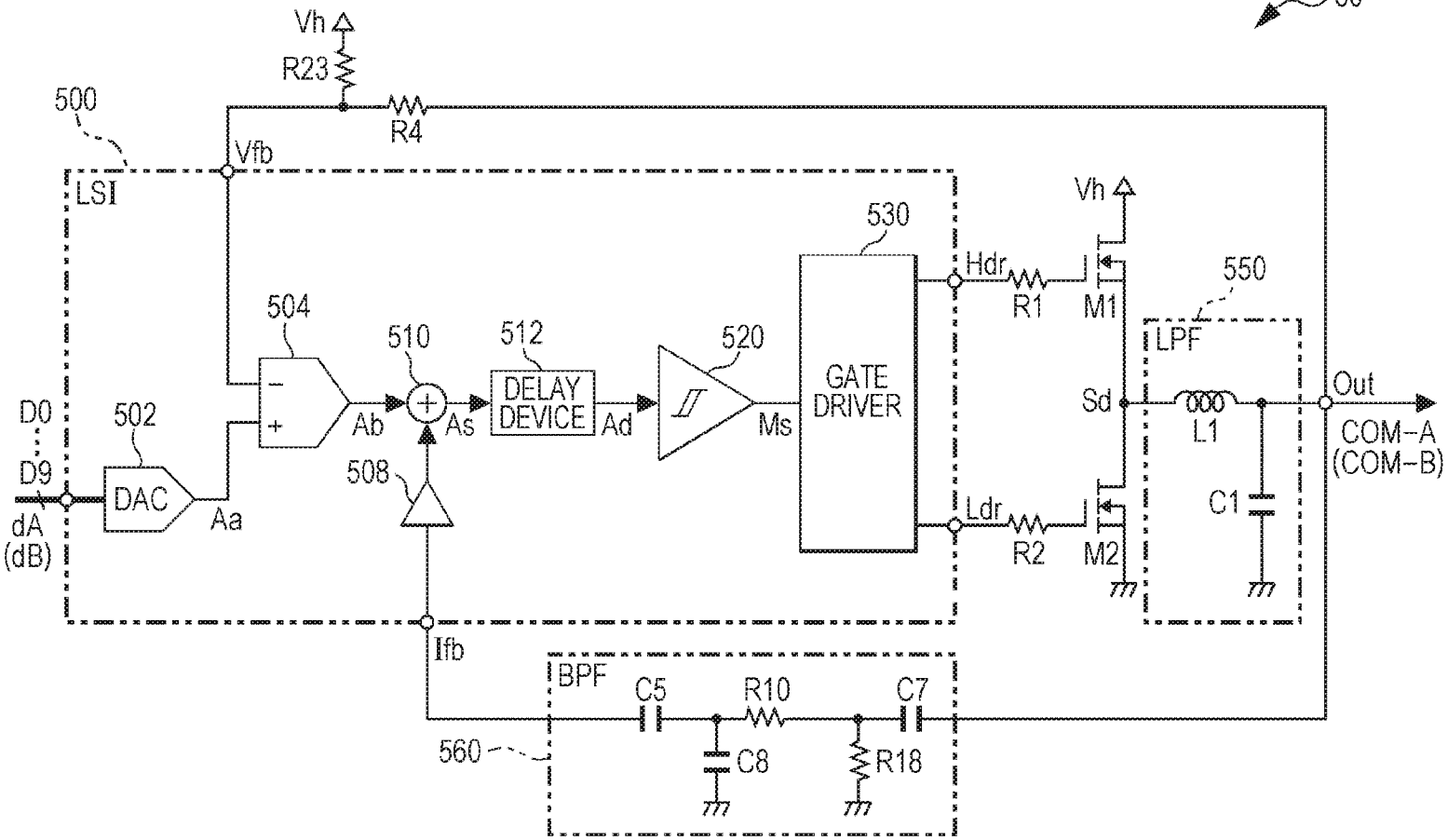
FIG. 10 is a diagram showing a configuration of a drive circuit in the printing device.

FIG. 10 is a diagram showing a circuit configuration of the drive circuit 50.

As shown in FIG. 10, the drive circuit 50 includes an LSI 500, N-channel type transistors M1 and M2, and various elements (components) such as resistors and capacitors.

The LSI (Large Scale Integration) 500 outputs a gate signal to, for example, each of the N-channel type FET (Field Effect Transistor) transistors M1 and M2 based on 10-bit data dA (dB) inputted from the controller 100 through pins D0 and D9. To output such a gate signal, the LSI 500 includes a DAC (Digital to Analog Converter) 502, adders 504 and 510, an attenuator 508, a delay device 512, a comparator 520, and a gate driver 530.

The DAC 502 converts the data dA (dB) that defines the waveform of the drive signal COM-A (COM-B) into an analog signal Aa and supplies the analog signal Aa to an input terminal (+) of the adder 504. A voltage amplitude of the analog signal Aa is, for example, about 0 to 2 volts and a signal obtained by amplifying the voltage by 20 times is the drive signal COM-A (COM-B). In other words, the analog signal Aa is a signal to be a target of the drive signal COM-A before the amplification.

An input terminal (−) of the adder 504 is supplied with a voltage of a terminal Out that is inputted through a pin Vfb, that is, the drive signal COM-A (COM-B).

The adder 504 integrates/attenuates the voltage of the input terminal (−) and then calculates the voltage with a voltage of the input terminal (+). Specifically, the adder 504 obtains a deviation calculated by subtracting the integrated/attenuated voltage of the input terminal (−) from the voltage of the input terminal (+) and supplies a signal Ab indicating the deviation to one input terminal of the adder 510.

A power supply voltage of a circuit from the DAC 502 to the comparator 520 is a low-amplitude of 3.3 volts. While the voltage of the analog signal Aa is about 2 volts at most, the voltage of the drive signal COM-A may exceeds 40 volts at most, so that the voltage of the drive signal COM-A (COM-B) is attenuated in order to equalize amplitude ranges of both voltages when obtaining the deviation.

The attenuator 508 attenuates a high frequency component of the drive signal COM-A (COM-B) inputted through a pin Ifb and supplies the attenuated drive signal COM-A to the other input terminal of the adder 510. In the same manner as the input terminal (−) of the adder 504, the attenuation of the attenuator 508 is to equalize voltage amplitudes when feeding back the drive signal COM-A (COM-B). The adder 510 supplies a signal As of a voltage obtained by adding a voltage at one input terminal and a voltage at the other input terminal to the delay device 512.

The voltage of the signal As outputted from the adder 510 is a voltage obtained by adding an attenuation voltage of a signal supplied to the pin Ifb to a deviation obtained by subtracting the attenuation voltage of the signal supplied to the pin Ifb from a voltage of the analog signal Aa that indicates a target. Therefore, it can be said that the voltage of the signal As outputted from the adder 510 is a signal obtained by correcting a deviation obtained by subtracting an attenuation voltage of the drive signal COM-A (COM-B), which is an output, from the voltage of the analog signal Aa, which is a target, by a high frequency component of the drive signal COM-A (COM-B).

The delay device 512 supplies a signal Ad obtained by delaying the signal As by a time described later to the comparator 520.

The comparator 520 outputs a modulation signal Ms that is pulse-modulated as described below based on the signal Ad delayed by the delay device 512. Specifically, the comparator 520 outputs the modulation signal Ms which becomes H level when the signal Ad becomes higher than or equal to a voltage threshold value Vth1 if the voltage of the signal Ad is rising and which becomes L level when the signal Ad becomes lower than a voltage threshold value Vth2 if the voltage of the signal Ad is falling. As described later, a relationship between the voltage threshold values is set as follows:

$$Vth1>Vth2$$

The modulation signal Ms outputted from the comparator 520 is supplied to the gate driver 530. The gate driver 530 converts the modulation signal Ms into a high-amplitude logic signal and supplies the high-amplitude logic signal to the gate electrode of the transistor M1 through a pin Hdr and a resistor R1, and further the gate driver 530 converts a signal obtained by inverting a logic level of the modulation signal Ms into a high-amplitude logic signal and supplies the high-amplitude logic signal to the gate electrode of the transistor M2 through a pin Ldr and a resistor R2.

Therefore, the logic levels of the gate signals supplied to the gate electrodes of the transistors M1 and M2 are in an exclusive relationship with each other.

A timing control may be performed so that the logic levels of the two gate signals outputted from the gate driver 530 do not become H level at the same time in practice (that is, a timing control may be performed so that the N-channel type transistors M1 and M2 do not turn on at the same time). Therefore, strictly speaking, the exclusive relationship here means that the logic levels of the two gate signals do not become H level at the same time (the transistors M1 and M2 do not turn on at the same time).

By the way, the modulation signal here is the modulation signal Ms in a narrow sense. However, if it is defined that the modulation signal is a signal which is pulse-modulated according to the signal Aa and drives the transistors M1 and M2, the gate signal to the transistor M1 and the gate signal to the transistor M2 are also included in the modulation signals. In other words, not only the modulation signal Ms, but also a signal obtained by inverting the logic level of the modulation signal Ms and a signal obtained by controlling the timing of the modulation signal Ms are included in the modulation signals which are pulse-modulated according to the signal Aa.

The comparator 520 outputs the modulation signal Ms, so that circuits from the DAC 502 to the comparator 520, that is, the DAC 502, the adders 504 and 510, the attenuator 508, the delay device 512, and the comparator 520, can be said to be a modulation circuit that generates the modulation signal Ms.

In the configuration shown in FIG. 10, the digital data dA (dB) is converted into the analog signal Aa by the DAC 502. However, the signal Aa may be supplied from an outside circuit according to an instruction of the controller 100 without using the DAC 502. Both the digital data dA (dB) and the analog signal Aa define a target value for generating the waveform of the drive signal COM-A (COM-B), so that they are surely source signals.

A voltage Vh (for example, 42 volts) is applied to the drain electrode of the high side transistor M1 of the transistors M1 and M2. The source electrode of the low side transistor M2 is connected to the ground.

Each of the transistors M1 and M2 is an N-channel type transistor in this example, so that each of the transistors M1 and M2 turns on when the gate signal is H level. Therefore, a modulated amplification signal, which is an amplified modulation signal Ms, appears at a connection point Sd between the source electrode of the transistor M1 and the drain electrode of the transistor M2, that is, one end of an inductor L1. Therefore, the transistors M1 and M2, which is a transistor pair, output the modulated amplification signal, which is an amplified modulation signal Ms.

The other end of the inductor L1 is a terminal Out which is the output of the drive circuit 50. The drive signal COM-A (COM-B) is supplied from the terminal Out to the head unit 20 through the flexible cable 190 (see FIGS. 1 and 2).

The terminal Out is connected to one end of a capacitor C1, one end of a capacitor C7, and one end of a resistor R4. The other end of the capacitor C1 is connected to the ground. Therefore, an LPF (Low Pass Filter) 550 is formed by the inductor L1 and the capacitor C1, and the LPF functions as a demodulator that smoothes and demodulates the amplified modulation signal that appears at the connection point between the transistors M1 and M2.

The other end of the resistor R4 is connected to the pin Vfb and one end of a resistor R23. The voltage Vh is applied to the other end of the resistor R23. Thereby, the drive signal COM-A (COM-B) from the terminal Out is pulled up and fed back to the pin Vfb.

The resistors R4 and R23 are externally connected to the LSI 500, but may be incorporated in the LSI 500.

The other end of the capacitor C7 is connected to one end of a resistor R18 and one end of a resistor R10. The other end of the resistor R18 is connected to the ground. Therefore, the capacitor C7 and the resister R18 function as an HPF (High Pass Filter) that causes a high frequency component, which is a part of the drive signal COM-A (COM-B) from the terminal Out and is higher than or equal to a cutoff frequency, to pass through. The cutoff frequency of the HPF is set to, for example, about 9 MHz.

The other end of the resistor R10 is connected to one end of a capacitor C5 and one end of a capacitor C8. The other end of the capacitor C8 is connected to the ground. Therefore, the resister R10 and the capacitor C8 function as an LPF that causes a low frequency component, which is a part of a signal component that has passed through the HPF and is lower than or equal to a cutoff frequency, to pass through. The cutoff frequency of the LPF is set to, for example, about 160 MHz.

The cutoff frequency of the HPF is set to lower than the cutoff frequency of the LPF, so that the HPF and the LPF function as a BPF (Band Pass Filter) 560 that causes a frequency component of a predetermined frequency range of the drive signal COM-A (COM-B) to pass through.

The other end of the capacitor C5 is connected to the pin Ifb of the LSI 500. Thereby, a direct current component of a high frequency component of the drive signal COM-A (COM-B) that has passed through the BPF is cut, and thereafter the drive signal COM-A (COM-B) is fed back to the pin Ifb.

The drive circuit 50 has two paths, which are a path through the pin Vfb and a path through the pin Ifb, as feedback paths. Among them, the path through the pin Ifb is dominant as a path that defines the frequency of self oscillation. Therefore, a feedback circuit means a circuit related to the path through the pin Ifb. Specifically, the feedback circuit means the LPF 550 and the BPF 560.

The drive signal COM-A (COM-B) outputted from the terminal Out is a signal obtained by smoothing the amplified modulation signal at the connection point Sd between the transistors M1 and M2 by the LPF 550. The drive signal COM-A (COM-B) is fed back to the adder 504 through the pin Vfb and outputted as the signal Ab that is a deviation from the signal Aa that is a target.

Here, for convenience of description, when a configuration is assumed in which the feedback through the pin Ifb and the delay by the delay device 512 are excluded, the drive signal COM-A (COM-B) are integrated/attenuated through the pin Vfb and fed back to the adder 504, so that the modulation signal Ms self-oscillates at a frequency determined by a transfer function of the feedback path, that is, a path through the LPF 550 and the adder 504.

However, the amount of delay of the feedback path through the pin Vfb is large, so that it is not possible to increase the frequency of the self-oscillation so as to secure a sufficient waveform accuracy of the drive signal COM-A (COM-B) by only the feedback through the pin Vfb.

Therefore, in the embodiment, in addition to the path through the pin Vfb, a path is provided in which a high frequency component of the drive signal COM-A (COB-B) is fed back through the pin Ifb, so that the delay of the whole circuit is reduced. Therefore, the frequency of the signal As, where the high frequency component of the drive signal COM-A (COB-B) is added to the signal Ab, is higher than that in a case in which there is not a path through the pin Ifb (that is, the frequency of the self oscillation becomes high), so that a ripple component is reduced in the drive signal COM-A (COB-B) and the accuracy of waveform is improved.

Figure 11:
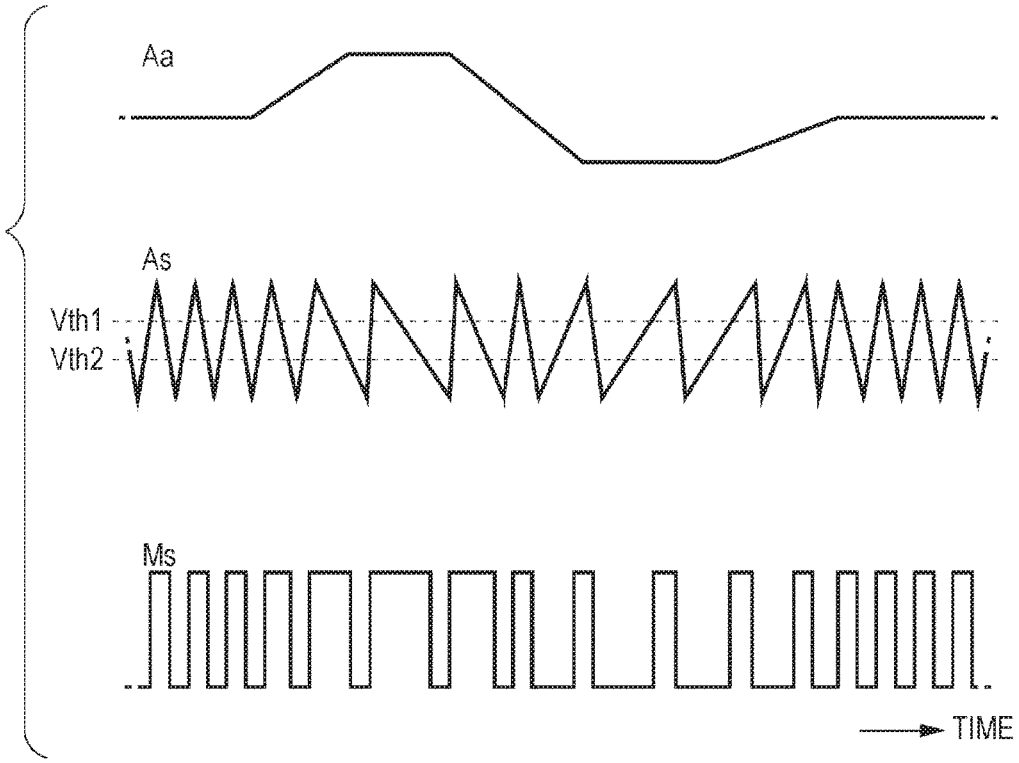
FIG. 11 is a diagram for explaining an operation of the drive circuit.

FIG. 11 is a diagram showing an ideal relationship between the signal As and the modulation signal Ms with respect to the waveform of the analog signal Aa.

As shown in FIG. 11, the signal As is a triangular wave, and an oscillating frequency of the signal As varies according to a voltage (an input voltage) of the analog signal Aa. Specifically, the oscillating frequency is highest when the input voltage is an intermediate value, and the oscillating frequency decreases as the input voltage rises from the intermediate value or the input voltage falls from the intermediate value. The signal As (Ad) is the self oscillation signal.

Regarding an inclination of the triangular wave of the signal As, the inclination of a rising signal (rising of voltage) and the inclination of a falling signal (falling of voltage) are substantially the same when the input voltage is close to the intermediate value. Therefore, a duty ratio of the modulation signal Ms, which is a result of comparing the signal As with the voltage threshold values Vth1 and Vth2 by the comparator 520, is about 50%. When the input voltage is increased from the intermediate value, a downward inclination of the signal Aa is reduced. Therefore, a time period in which the modulation signal Ms is H level is relatively long, so that the duty ratio increases. On the other hand, as the input voltage is decreased from the intermediate value, an upward inclination of the signal Aa is reduced. Therefore, a time period in which the modulation signal Ms is L level is relatively short, so that the duty ratio decreases.

Therefore, the modulation signal Ms becomes a pulse density modulation signal as described below. The duty ratio of the modulation signal Ms is about 50% at the intermediate value of the input voltage. The higher the input voltage is than the intermediate value, the greater the duty ratio is, and the lower the input voltage is than the intermediate value, the smaller the duty ratio is.

The gate driver 530 turns on/off the transistors M1 and M2 based on the modulation signal Ms as described above. Specifically, when the modulation signal Ms is H level, the gate driver 530 turns on the transistor M1 and turns off the transistor M2. On the other hand, when the modulation signal Ms is L level, the gate driver 530 turns off the transistor M1 and turns on the transistor M2.

Therefore, the voltage of the drive signal COM-A (COM-B) obtained by smoothing the amplified modulation signal at the connection point Sd between the transistors M1 and M2 by the inductor L1 and the capacitor C1 becomes higher as the duty ratio of the modulation signal Ms becomes greater and becomes lower as the duty ratio of the modulation signal Ms becomes smaller. Therefore, as a result, the drive signal COM-A (COM-B) is controlled to be a signal where the voltage of the analog signal Aa is increased and then the drive signal COM-A (COM-B) is outputted.

The drive circuit 50 uses pulse density modulation, so that there is an advantage that a large variation width of the duty ratio can be obtained as compared with pulse width modulation where the modulation frequency is fixed.

Specifically, a minimum positive pulse width and a minimum negative pulse width which can be handled by the entire circuit are restricted by the characteristics of the circuit, so that in the pulse width modulation where the frequency is fixed, only a predetermined range (for example, a range from 10% to 90%) of the variation width of the duty ratio can be secured. On the other hand, in the pulse density modulation, as the input voltage becomes away from the intermediate value, the oscillating frequency decreases, so that it is possible to further increase the duty ratio in an area where the input voltage is high and it is possible to further decrease the duty ratio in an area where the input voltage is low. Therefore, in a self oscillation type pulse density modulation, it is possible to secure a larger range (for example, a range from 5% to 95%) of the variation width of the duty ratio.

Further, the drive circuit 50 is a self oscillation circuit, so that it is not necessary to generate a high frequency carrier wave as in the separately-excited oscillation. Therefore, there is an advantage that it is possible to easily integrate circuits other than circuits that handle high voltage, that is, the functions performed by the LSI 500.

The drive circuit 50 is a configuration in which various elements such as LSIs, capacitors, and resistors are mounted on a circuit board. Therefore, next, how the elements included in the drive circuit 50 are arranged and mounted on any of circuit boards will be described.

Figure 12:
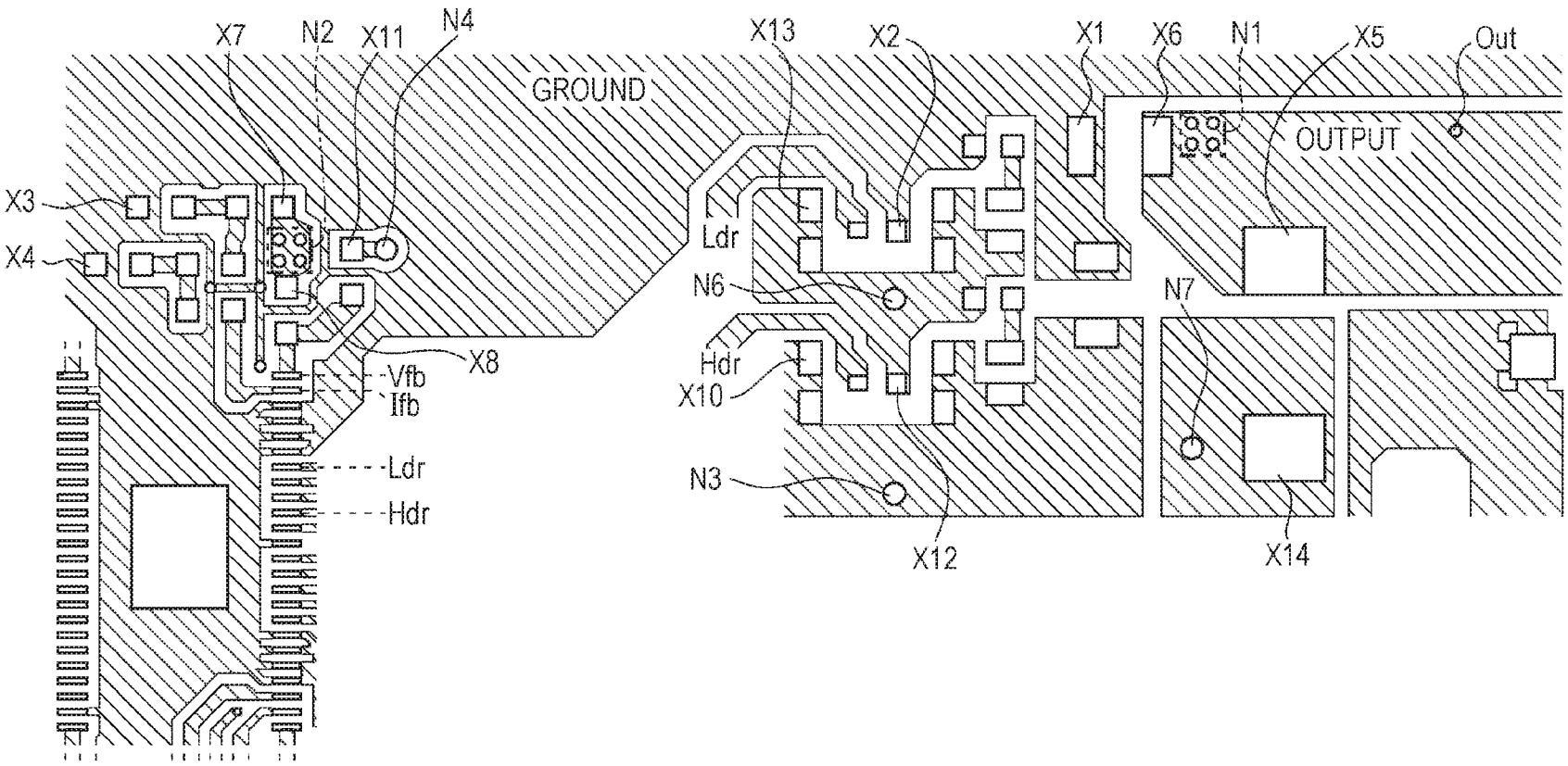
FIG. 12 is a plan view showing a wiring pattern of a circuit board on which the drive circuit is mounted.
Figure 13:
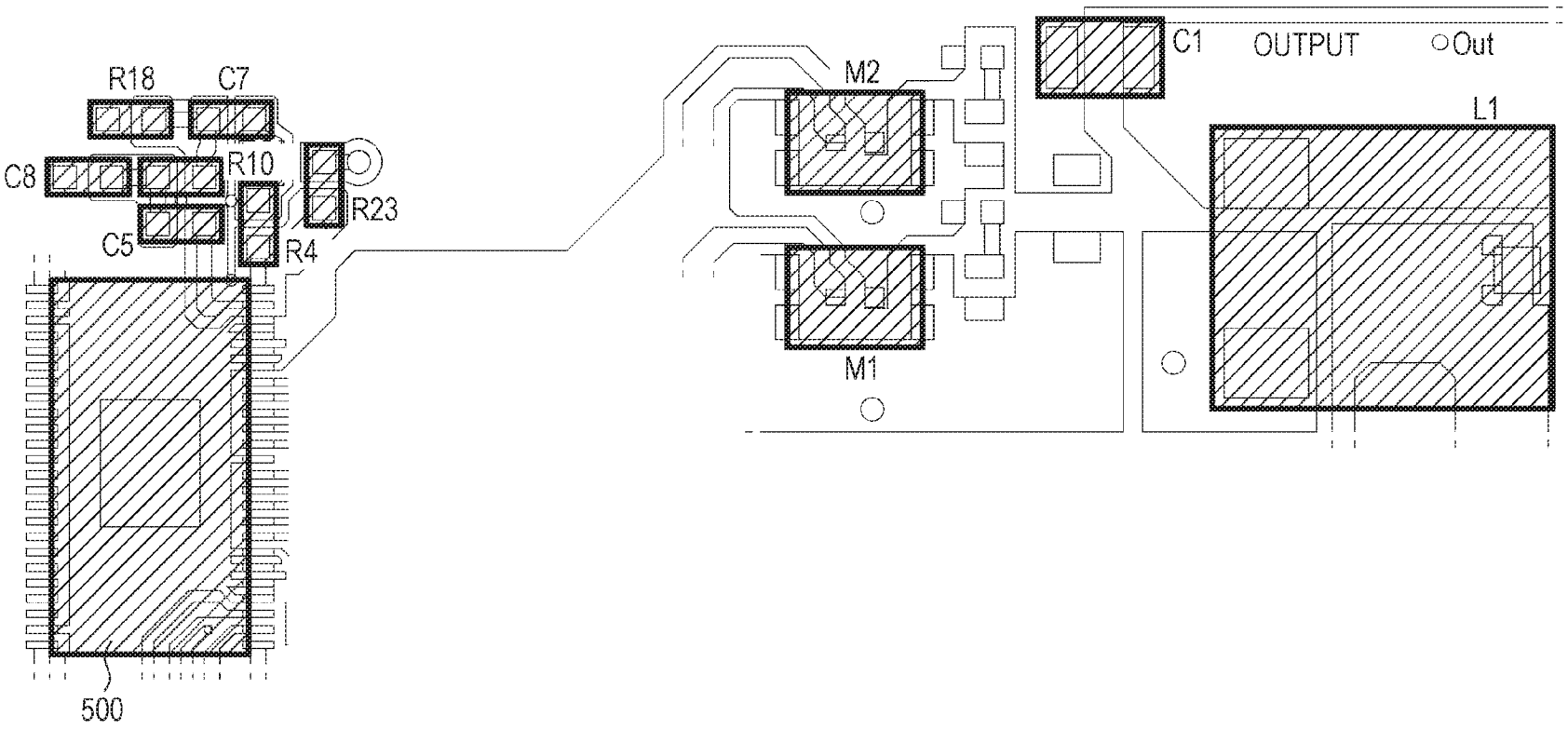
FIG. 13 is a diagram showing an arrangement of elements mounted on the circuit board.

FIG. 12 is a diagram showing a wiring pattern of a circuit board when seeing the circuit board in a plan view. FIG. 13 is a diagram showing an arrangement of elements mounted on the circuit board in relationship with the wiring pattern shown in FIG. 12.

As shown in FIG. 13, the circuit board is mounted with the LSI 500 that forms the drive circuit 50, the transistors M1 and M2, the inductor L1, the capacitors C1, C5, C7, and C8, and the resistors R4, R10, R18, and R23.

In FIGS. 12 and 13, a gate signal outputted from the pin Hdr of the LSI 500 is supplied to the gate electrode of the transistor M1 through the resistor R1 (omitted in FIGS. 12 and 13). Similarly, a gate signal outputted from the pin Ldr is supplied to the gate electrode of the transistor M2 through the resistor R2 (omitted in FIGS. 12 and 13).

The terminal X1 connected to the other end of the capacitor C1, the terminal X2 connected to the source electrode of the transistor M2, the terminal X3 connected to the other end of the resistor R18, and the terminal X4 connected to the other end of the capacitor C8 are connected to a ground pattern.

A through hole N1 is provided in a pattern (output, terminal Out) including the terminal X5 connected to the other end of the inductor L1 and the terminal X6 connected to one end of the capacitor C1. On the other hand, a through hole N2 is provided in a pattern including the terminal X7 connected to one end of the capacitor C7 and the terminal X8 connected to one end of the resistor R4.

In the circuit diagram of FIG. 10, the drive signal COM-A (COM-B) is divided into two systems from the terminal Out and fed back to the pins Vfb and Ifb of the LSI 500. However, in practice, as shown in FIG. 12, the drive signal COM-A (COM-B) sequentially passes through the through hole N1 provided in the pattern including the terminal Out, an inner wiring pattern (not shown in the drawings), and the through hole N2 and branches to one end of the resistor R4 and one end of the capacitor C7. Among them, a path to the resistor R4 is fed back to the pin Vfb and a path to the capacitor C7 is fed back to the pin Ifb.

The inner wiring pattern here is a wiring pattern formed in a layer other than a first layer when the wiring pattern shown in FIG. 12 is defined as the first layer.

A through hole N3 is provided in a pattern including the terminal X10 connected to the drain electrode of the transistor M1. Further, a through hole N4 is provided in a pattern including the terminal X11 connected to the other end of the resistor R23. The through holes N3 and N4 are connected to an internal pattern not shown in the drawings and the voltage Vh is applied to each of the through holes N3 and N4.

A through hole N6 is provided in a pattern (the connection point Sd in FIG. 10) including the terminal X12 connected to the source electrode of the transistor M1 and the terminal X13 connected to the drain electrode of the transistor M2. A through hole N7 is provided in a pattern including the terminal X14 connected to one end of the inductor L1. The through hole N6 and the through hole N7 are electrically connected to each other through an inner wiring pattern (not shown in the drawings).

As described above, in the embodiment, the drive circuit 50 is formed by mounting various elements on the circuit board. Here, the LPF 550 is arranged to be close to the terminal Out that is an output terminal.

Figure 14:
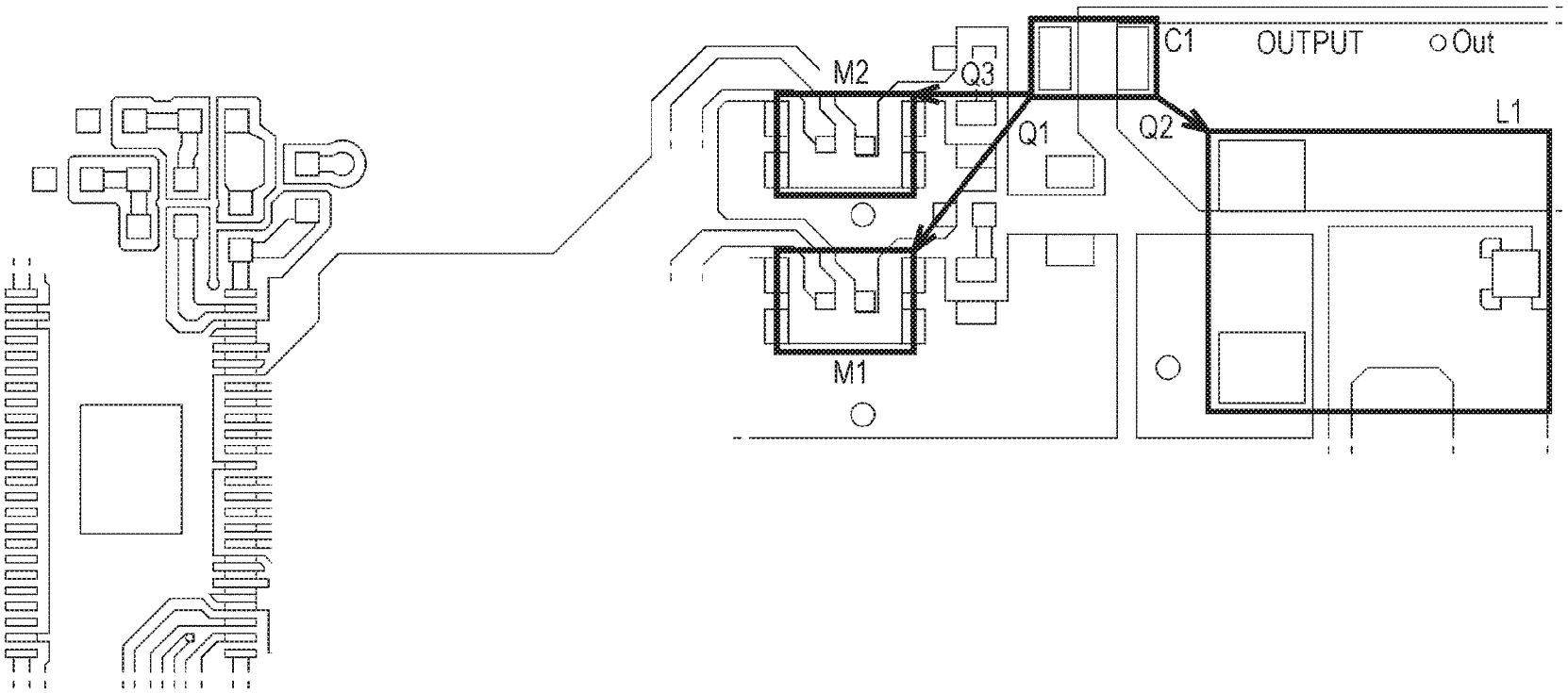
FIG. 14 is a diagram showing a positional relationship among elements mounted on the circuit board.

FIG. 14 is a diagram for explaining such an arrangement.

As shown in FIG. 14, the capacitor C1 included in the LFP 550 is arranged closer to the inductor L1 than to the transistor M1. In other words, the capacitor C1 is arranged so that the distance Q1 from the capacitor C1 to the transistor M1 is longer than the distance Q2 from the capacitor C1 to the inductor L1.

The distance between elements here is, for example, a shortest length from an outer shape of one element to an outer shape of the other element in a state in which the elements are mounted on the circuit board. Therefore, if the elements are closely attached to each other, the distance between the elements is zero.

According to such an arrangement, the transistor M1 and the capacitor C1 are separated from each other, so that effects which noise generated when the transistor M1 switches a higher voltage has on the capacitor C1 are reduced. Further, the inductor L1 and the capacitor C1 are close to each other, so that an inductance component parasitizing in the capacitor C1 becomes small. When the inductance component becomes large, the modulation signal may abnormally oscillate or the frequency may vary, so that the operation becomes unstable. However, in the embodiment, the inductance component is suppressed to be small, so that the operation is stabilized.

Further, the distance Q3 between the transistor M2 and the capacitor C1 is shorter than the distance Q1 between the transistor M1 and the capacitor C1. Therefore, an inductance component and a resistance component parasitizing in the capacitor C1 and a wiring pattern between the other end of the capacitor C1 and the source electrode of the transistor M2 become small, so that abnormal oscillation and the like are suppressed.

From a viewpoint of reducing the inductance component parasitizing in the capacitor C1, the distance between the inductor L1 and the capacitor C1 should be zero. However, if that is done, effects of leakage flux from the inductor L1 reach the capacitor C1 and cause abnormal oscillation of the modulation signal and variation of the frequency, so that stability is impaired.

On the other hand, when the distance between the inductor L1 and the capacitor C1 is long, the inductance component parasitizing in the capacitor C1 is large, so that the operation becomes unstable as described above.

FIGS. 15 and 16 are diagrams for explaining effects on the distance Q2 between the inductor L1 and the capacitor C1 mounted on the circuit board. Specifically, FIG. 15 is a diagram showing characteristics of a ripple voltage (width) of the drive signal with respect to the distance Q2 and FIG. 16 is a diagram showing characteristics of the ripple voltage (center) of the drive signal with respect to the distance Q2.

FIG. 17 is a diagram for explaining the ripple voltage (width and center) of the drive signal. As shown in FIG. 17, in the waveform of the drive signal with ripples, a voltage from the top to the bottom is defined as a ripple voltage (width). Further, in the waveform of the drive signal, when the bottom is defined as a reference of voltage zero, a voltage at the center between the top and the bottom is defined as a ripple voltage (center).

In the drive circuit 50, the amplified modulation signal is demodulated by the LPF 550, so that the drive signal is outputted. However, the ripples of the drive signal are not completely removed and still remain as shown in a partially enlarged manner in FIG. 17. When the ripples are large, abnormal oscillation of the modulation signal and the like easily occur.

As shown in FIGS. 15 and 16, when the distance Q2 between the inductor L1 and the capacitor C1 gradually increases from 0.0 mm, the ripple voltage (width and center) gradually decreases. However, when the distance Q2 is smaller than 3.0 mm, the effects of leakage flux from the inductor L1 reach the capacitor C1 and the ripple voltage (width and center) is still high, so that abnormal oscillation of the modulation signal and the like easily occur.

When the distance Q2 is greater than or equal to 3.0 mm, the effects of leakage flux from the inductor L1 decrease and the ripple voltage (width and center) decreases, so that it is possible to stabilize the operation. However, when the distance Q2 exceeds 6.0 mm, the inductance component parasitizing in the ground wiring pattern and the capacitor C1 becomes large and the ripple voltage (width and center) increases, so that abnormal oscillation of the modulation signal and the like easily occur. Further, when the distance Q2 is long, it is necessary to secure a circuit space more than necessary, so that downsizing of the circuit scale is hampered.

Therefore, it can be said that the distance Q2 between the inductor L1 and the capacitor C1 is desired to be greater than or equal to 3.0 mm and smaller than or equal to 6.0 mm.

As described above, according to the embodiment, the operation of the drive circuit can be stabilized by the arrangement of elements on a drive substrate, so that it is not necessary to add other elements and circuits and it is possible to prevent the cost from increasing.

The invention is not limited to the embodiment described above, and for example, various modifications and applications as described below can be implemented. Regarding aspects of the modifications and applications described below, one or a plurality of arbitrarily selected aspects can be appropriately combined.

In the embodiment, when the drive circuit 50 generates the modulation signal Ms, the drive circuit 50 feeds back the drive signal COM-A (COM-B) obtained by smoothing the amplified modulation signal by the LPF 550. However, the drive circuit 50 may feed back the modulation signal Ms itself. Although not shown in the drawings, for example, an error between the modulation signal Ms and the input signal As is calculated, and a signal delayed by the error and the target signal Aa are added together or subtracted from each other, and then the calculation result may be inputted into the comparator 520.

The amplified modulation signal that appears at the connection point Sd between the transistors M1 and M2 is different from the modulation signal Ms by only the logical amplitude, so that, for example, the amplified modulation signal is attenuated and the attenuated amplified modulation signal may be fed back in the same manner as the modulation signal Ms.

In the embodiment shown in FIG. 2, for convenience of description, the number of nozzles is relatively small and two drive circuits 50-*a* and 50-*b* output the drive signals COM-A and COM-B respectively. However, drive circuits that output drive signals COM-C, COM-D, and so on may be further provided. In other words, the number of drive circuits is not limited to "2".

The printing device 1 is not necessarily a device that discharges ink while reciprocating the head unit including a plurality of nozzles 651, but may be a so-called line printer including a plurality of head units in which nozzles are arranged in a direction perpendicular or diagonal to a sub scanning direction and which are fixed with respect to a housing.

In the embodiment, as an object to be driven by the drive circuit 50, the piezoelectric element 60 that discharges ink is described as an example. However, the object to be driven is not limited to the piezoelectric element 60, but may be, for example, a capacitive load such as an ultrasonic motor, a touch panel, a flat speaker, and a liquid crystal display. In short, the drive circuit 50 may be a circuit that drives such a capacitive load.

What is claimed is:

1. A liquid discharge device, comprising:

a modulation circuit that generates a modulation signal obtained by pulse-modulating a source signal by self oscillation;

a transistor pair which includes a high side transistor and a low side transistor and which generates an amplified modulation signal by amplifying the modulation signal;

a demodulator which includes an inductor and a capacitor and which generates a drive signal by smoothing the amplified modulation signal;

an piezoelectric element that is displaced when the drive signal is applied;

a cavity inside which a liquid droplet is filled and whose internal volume is changed by the displacement of the piezoelectric element; and a nozzle provided to discharge liquid inside the cavity according to the change of the internal volume of the cavity, wherein a distance between the high side transistor and the capacitor is longer than a distance between the inductor and the capacitor.

2. The liquid discharge device according to claim 1, wherein the distance between the inductor and the capacitor is longer than or equal to 3 mm.

3. The liquid discharge device according to claim 1, wherein the distance between the inductor and the capacitor is shorter than or equal to 6 mm.

4. The liquid discharge device according to claim 1, wherein a distance between the low side transistor and the capacitor is shorter than a distance between the high side transistor and the capacitor.

5. The liquid discharge device according to claim 1, wherein a frequency of the self oscillation is greater than or equal to 1 MHz and smaller than or equal to 8 MHz.

6. A head unit, comprising:

an piezoelectric element that is displaced when a drive signal is applied;

a cavity inside which a liquid droplet is filled and whose internal volume is changed by the displacement of the piezoelectric element; and a nozzle provided to discharge liquid inside the cavity according to the change of the internal volume of the cavity, wherein the drive signal is obtained by smoothing an amplified modulation signal by a demodulator including an inductor and a capacitor, the amplified modulation signal is generated by amplifying a modulation signal by a transistor pair including a high side transistor and a low side transistor, the modulation signal is generated by pulse-modulating a source signal by self oscillation of a modulation circuit, and a distance between the high side transistor and the capacitor is longer than a distance between the inductor and the capacitor.

* * * * *